United States Patent [19]

Shutt

[11] Patent Number: 4,711,195

[45] Date of Patent: Dec. 8, 1987

[54] HYDROFOIL APPARATUS

[76] Inventor: Sidney G. Shutt, 612 Briarwood Dr., Brea, Calif. 92621

[21] Appl. No.: 37,156

[22] Filed: Apr. 10, 1987

[51] Int. Cl.[4] ..... B63B 35/00

[52] U.S. Cl. ..... 114/274; 114/275; 114/280; 114/281

[58] Field of Search ..... 114/271, 274, 275, 276, 114/277, 278, 280, 281, 39.1

[56] References Cited

U.S. PATENT DOCUMENTS

| | | | |
|---|---|---|---|
| 2,139,303 | 12/1938 | Grunberg | 114/283 |
| 2,387,907 | 10/1945 | Hook | 114/276 |
| 2,603,179 | 7/1952 | Gardiner | 114/280 |
| 2,773,467 | 12/1956 | Bailey | 114/280 |
| 3,112,725 | 12/1963 | Malrose | 114/39 |
| 3,286,673 | 11/1966 | Nason | 114/282 |
| 3,322,089 | 5/1967 | Hook | 114/280 |
| 3,747,549 | 7/1973 | Shutt | 114/280 |
| 3,762,353 | 10/1973 | Shutt | 114/281 |

*Primary Examiner*—Jeffrey V. Nase
*Assistant Examiner*—Stephen P. Avila
*Attorney, Agent, or Firm*—James F. Kirk

[57] ABSTRACT

A hydrofoil apparatus for attachment to a marine vessel having a first pivot means for positioning the rotational axis of a gooseneck shaft parallel to the yaw axis of the hull and a trailing load support arm having a forward end coupled to the gooseneck. A planing surface sensor or planing foil rides on the water surface. The planing surface provides a hydrodynamic force to hold the planing surface sensor on surface as the vessel moves with forward velocity. An elongated body member is pivotally coupled to rotate on a first pitch axis with respect to said planing surface sensor. The elongated body member is pivotally coupled to the trailing load support at its aft end. A vertical fin is coupled to support the elongated body member. The fin maintains the planing surface sensor forward of said second pitch axis. A lifting foil raises the bow of said marine vessel by provide a lifting force via the fin.

12 Claims, 13 Drawing Figures

HYDROFOIL APPARATUS

BACKGROUND OF INVENTION

1. Field of Invention

This invention relates to the field of marine vessels and more particularly to the field of boats using hydrofoils for the purpose of raising a portion or all of the null of the boat free of the water. This invention pertains more particularly to the field of manually powered boats or sail boats having a propulsion source, such as a manually powered or electrically powered propulsion system.

2. Prior Art

Hydrofoil lifting surfaces designed to apply a lifting force to the hull of a marine vessel are known in the art. Such hydrofoil surfaces have either a fixed angle of attack, or an angle of attack that is adjusted by a control system within the marine vessel.

U.S. Pat. No. 3,762,353 titled "High Speed Sail Boat" issued Oct. 2, 1973 and having the same inventor as the subject invention characterizes a sail boat using a hydrofoil on an outrigger flotation means to provide a counter heeling force to keep the sailboat upright. FIG. 9 of the U.S. Pat. No. 3,762,353 patent shows a fixed horizontal foil to lift the stern portion of the hull out of the water to reduce drag. A planing surface arrangement is shown mounted on the bow that is lowered by the operator; however, no provision is shown for pivoting the bow foil apparatus on a yaw pivot axis.

U.S. Pat. No. 3,747,549 titled "High Speed Sailboat" issued July 24, 1973 and having the same inventor as the subject invention is similar to U.S. Pat. No. 3,762,353 but fails to show a horizontal separation of the second pivot point from the yaw pivot at the gooseneck.

U.S. Pat. No. 3,762,353 cites three reference patents which include U.S. Pat. No. 3,286,673 titled "Hydrofoil Stabilizing Means For Watercraft" issued Nov. 22, 1966 to H. W. Nason. This patent shows a hydrofoil used to stabilize a sailboat in roll but does not teach a planing surface sensor arrangement for controlling the hydrofoil angle of attack and no first and second pivot points and no bow attachment assembly is shown on a yaw pivot axis.

U.S. Pat. No. 3,112,725 titled "Sailboat" issued Dec. 3, 1963 to Leroy Malrose shows no submerged hydrofoil.

U.S. Pat. No. 2,139,303 titled "Watercraft" issued Dec. 6, 1938 to W. Grunberg, and Dit Greg shows a vessel supported out of the water on submerged hydrofoils placed behind the center of mass, stationary floats being positioned at its bow. No provision is made for a forward vertical fin, for first and second pivot points nor for pivoting the bow on a yaw axis.

SUMMARY OF INVENTION

It is a first object of the subject invention hydrofoil apparatus when it is coupled to the forward end or bow of a marine vessel to raise the bow to a predetermined height above the water and to continue to support it at that height while the vessel maintains a speed in excess of a predetermined lower limit while the rear of the vessel is supported at substantially the same height by an art horizontal lifting hydrofoil, hereafter referred to as a 10 foil. The rear foil is typically formed to have a predetermined dinedral to ennance the roll stability of the craft when at speed and raised to a supported position on the horizontal foil.

It is a second object of the invention hydrofoil apparatus to provide the operation of the vessel with an alternative means of steering the craft. The invention hydrofoil apparatus has a vertical fin that operates as a rubber which the operator can control at speed. As the vessel is rolled to the left or to the right, the invention hydrofoil apparatus turns the bow into the turn thereby altering the course of the vessel.

In an alternative application, multiple hydrofoil apparatus inventions are used to lift the bow or stern of a vessel and support it at a predetermined height above the water.

The invention has a first pivot means for positioning the rotational axis of a gooseneck shaft to a position substantially parallel to the yaw axis of the null of the marine vessel. A trailing load support is an elongated member that has a forward end and an aft end. The forward end is pivotally coupled to the gooseneck shaft for rotation on the yaw axis.

The hydrofoil apparatus has a planing surface that provides a hydrodynamic force to the planing surface sensor on the surface of the water in response to vessel forward velocity.

An elongated body member is included that has a forward end and an aft end, the forward end being pivotally coupled to rotate on a first pitch axis with respect to the planing surface sensor. The elongated body member is pivotally coupled to rotate on a second pitch axis passing through a point located between the elongated body forward and aft ends and the trailing load support aft end.

The invention has a vertical fin that has a first and second end. The first end is fixed to the elongated body member aft end. The fin is responsive to the forward motion of the marine vessel to maintain the planing surface sensor forward of the second pitch axis. The vertical fin upper end is coupled to the elongated body member aft end. The vertical fin extending below elongated member, said vertical fin having a lower end coupled to receive a lifting force from a submerged lifting foil in response to vessel forward velocity. The lifting foil is responsive to the forward motion of the marine vessel to raise the bow of the marine vessel by provide a lifting force via the second pitch axis to balance the lifting force provided by the planing surface sensor applied to the first pitch axis.

In an alternative embodiment, the first pivot means for positioning the rotational axis of a gooseneck shaft substantially parallel to the yaw axis of the hull of said marine vessel has a bow attachment assembly for raising and lowering the gooseneck shaft with respect to the hull of the marine vessel.

PREFERRED EMBODIMENT

Figure 1:
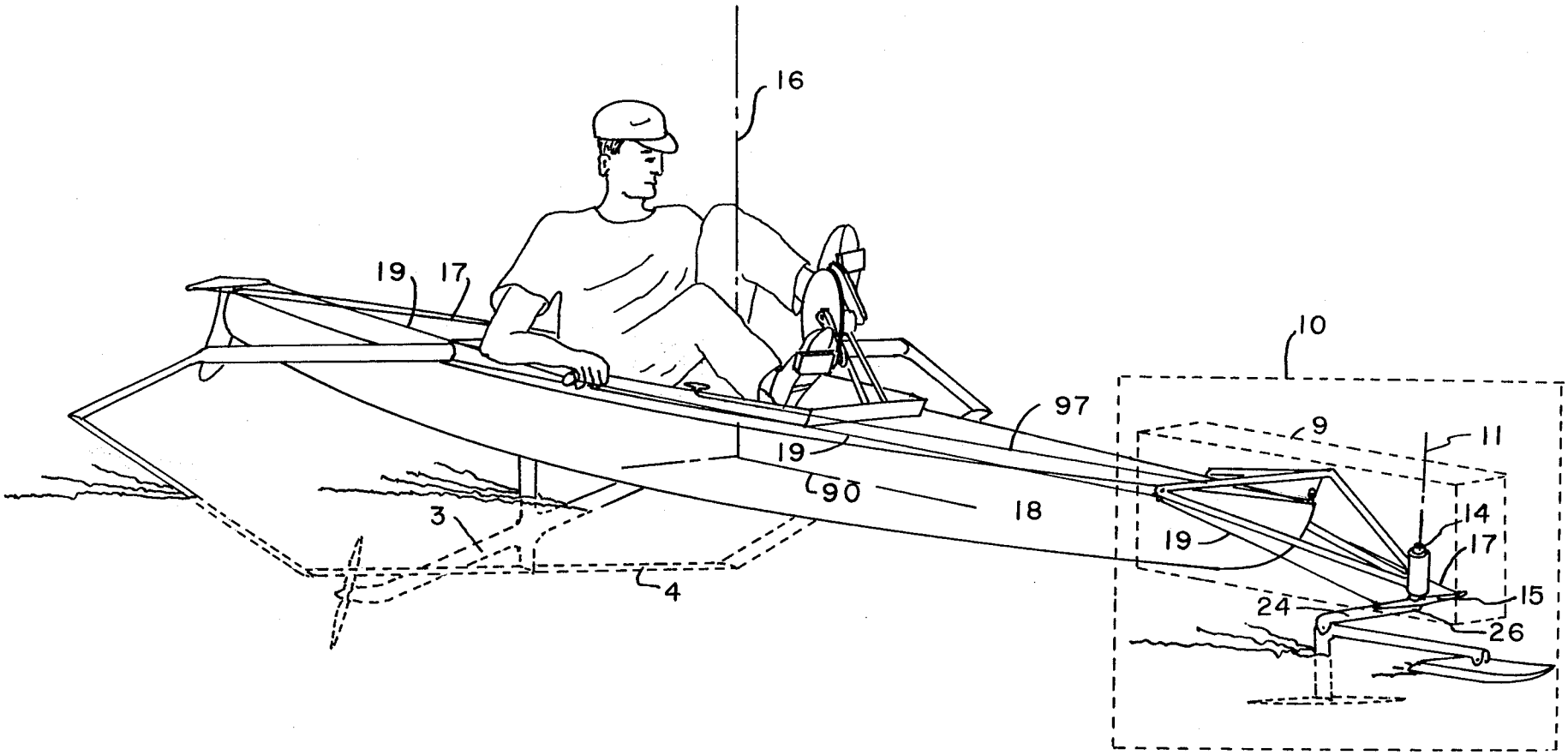
FIG. 1 is a perspective view of a manually powered marine vessel. The invention hydrofoil apparatus is shown in perspective at the bow of the vessel.

FIG. 1. is a perspective view showing the invention hydrofoil apparatus 10 attached to the bow of a marine vessel. The invention shown has a first pivot means 9 for positioning the rotational axis 11 of a gooseneck shaft 14 substantially parallel to the yaw axis 16 of the hull of vessel 18.

Figure 2:
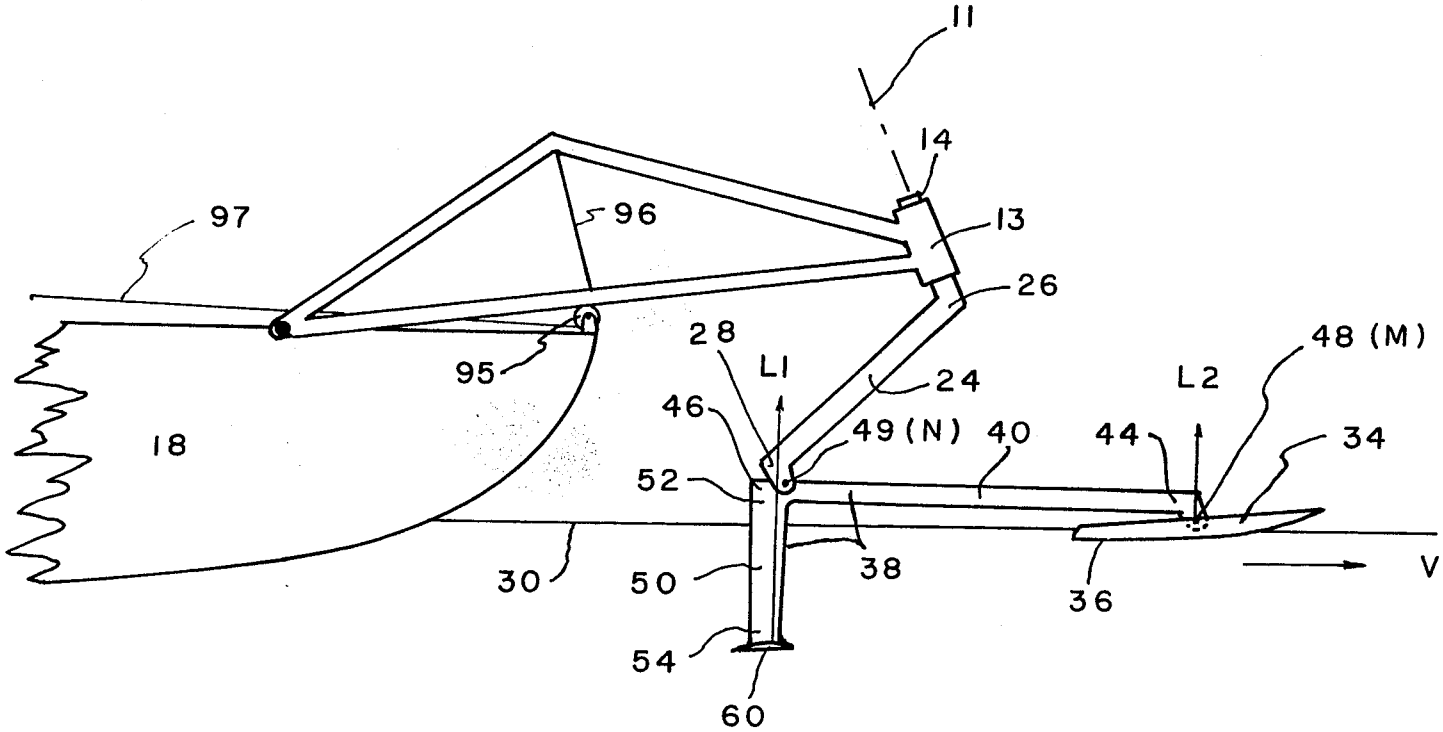
FIG. 2 is a side view of the invention hydrofoil apparatus in a raised position.

FIG. 2 is a side view of the invention hydrofoil apparatus in a raised position showing the invention having a trailing load support 24. This member has a forward end 26 coupled to the gooseneck shaft 14 which is pivotally coupled to the gooseneck housing 13 for rotation on yaw axis 11. The trailing load support 24 also has aft end 28.

The surface of the water 30 is represented by a horizontal line on which a planing surface sensor 34 rides. The planing surface sensor has a planing surface 36 in contact with the water surface 30. The planing surface 36 provides a hydrodynamic force characterized by vector L2 to hold the planing surface sensor on the water surface 30 in response to vessel forward velocity in the direction of vector V. The "L" shaped member 38 has an elongated body member 40. This member has forward end 44 and an aft end 46. The forward end 44 is pivotally coupled to rotate on a first pitch axis 48 with respect to the planing surface sensor 34. The elongated body member 40 is pivotally coupled to rotate on a second pitch axis 49 passing through a point located between said elongated body forward and aft ends 44, 46 respectively.

A vertical fin 50 has first and second ends, 52, 54 respectively. The first end is fixed to the elongated body member aft end. The vertical fin is responsive to the forward motion of the marine vessel to maintain the planing surface sensor forward of the second pitch axis 49.

A lifting foil 60 is coupled to the vertical fin. The lifting foil is responsive to the forward motion of the marine vessel to raise the bow of the marine vessel by provide a lift L1 force via the second pitch axis 49 to balance the lifting force L2 provided by the planing surface sensor applied to the first pitch axis 48.

Figure 3:
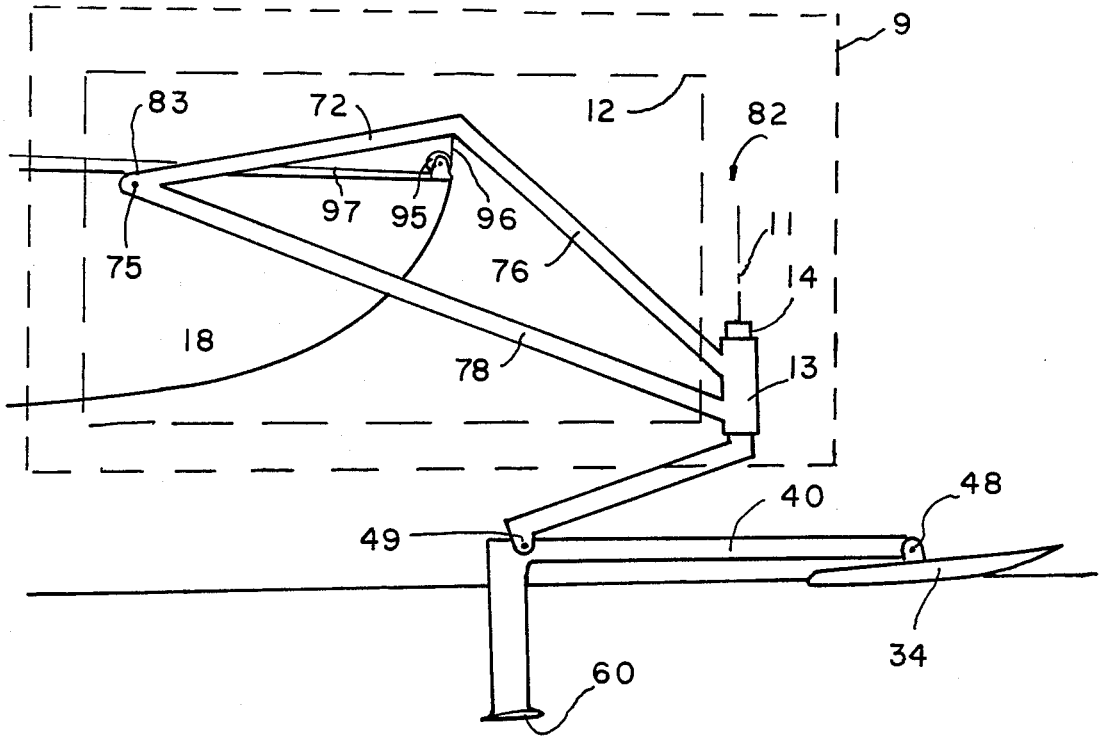
FIG. 3 is a side view of the invention hydrofoil apparatus in a lowered position.

FIGS. 2 and 3 show the first pivot means 9 for positioning the rotational axis of a gooseneck shaft to be substantially parallel to the yaw axis 16 of the hull of the marine vessel. FIGS. 2 and 3 depict the first pivot means in a raised and lowered position respectively. The first pivot means of this embodiment is additionally characterized to priovide a bow attachment assembly for raising and lowering said gooseneck shaft with respect to the hull of said marine vessel.

Figure 4:
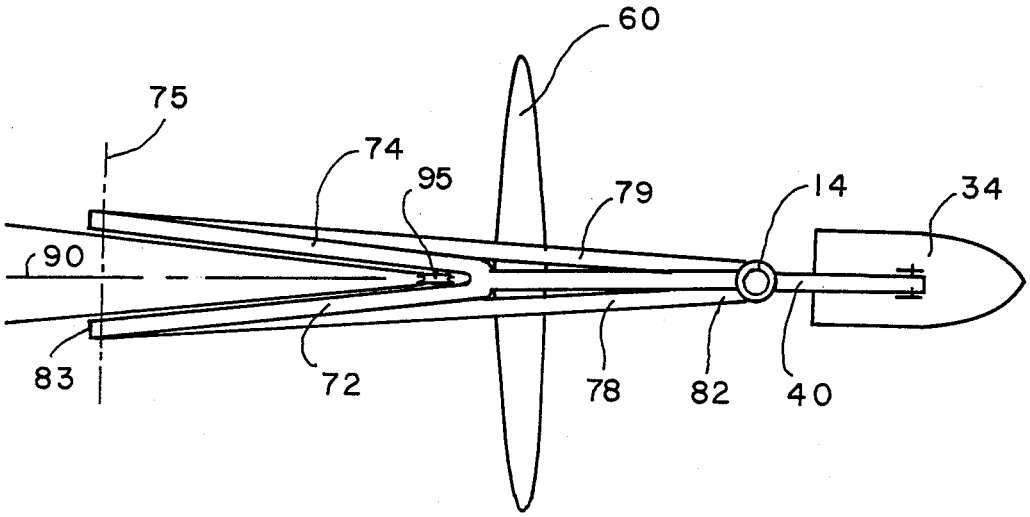
FIG. 4 is a top view of the invention hydrofoil apparatus.

FIGS. 3 and 4, show the bow attachment assembly 12 for raising and lowering said gooseneck shaft with respect to the hull of said marine vessel 18 in further detail. The bow attachment assembly has a principle structure comprising upper left and right longitudinal support members 72 and 74 respectively and lower longitudinal support members 78 and 79. As shown in FIG. 3 and FIG. 4, the principle structure has a forward end 82 and a rear end 83. The principle structure is disposed along an axis between the forward and rear end. The rear end of the structure is positioned at a forward location on said vessel 18, i, e. the bow. The principle structure is pivotally coupled on axis 75 to the vessel. Axis 75 is a norizontal axis that is transverse to the longitudinal axis 90 of the hull. The principle structure's longitudinal axis is parallel to the longitudinal axis 90 of the vessel in FIG. 4. The longitudinal axis of the principle structure is aligned to position the forward end 82 to be in a substantially raised position forward of the rear end 83 along the longitudinal axis 90 of the vessel. The attachment structure forward end position describes a predetermined arc segment as the structure is lowered or raised. The position of the arc segment is contained in a substantially vertical plane as the structure is pivoted on the pivotal axis 75 through the predetermined arc to move said forward end from a raised to a lowered position.

FIG. 3 shows a pulley means sucn as pulley 95, pull down line 96 and operator line 97. The bow attachment assembly uses this pulley means for raising and lowering said gooseneck shaft with respect to the hull of said marine vessel. The pulley means depicted is coupled to the bow foil attachment assembly to rotate it on the pivotal axis 75 through a predetermined arc segment, (not shown). The arc segment is contained in a plane passing through the longitudinal axis 90 and the yaw axis 16 of the vessel.

FIG. 1 shows that the bow attachment assembly for raising and lowering the gooseneck shaft with respect to the hull of the marine vessel has a bell crank 15 and left and right operator lines 17, 19 respectively. These elements cooperate as a means for rotating the gooseneck shaft 14 under operator control to steer the vessel 18. The operator pulls on one line and releases tension on the other to rotate the gooseneck shaft and to turn the vehicle.

FIG. 1 shows the pivot means 9 for positioning the rotational axis of a gooseneck shaft 11 to be substantially parallel to the yaw axis 16 of the hull of the marine vessel. The first pivot means has a gooseneck housing shown as 13 in FIG. 3. A gooseneck coupling is formed from the combination of the gooseneck shaft 14 and gooseneck housing 13. The gooseneck shaft is a rotatable shaft that is axially positioned in and extends from the gooseneck housing 13. The axis of the rotational shaft 14 characterizes a gooseneck rotational axis 11. The gooseneck housing 13 is coupled to the bow attachment assembly forward end 82 to position the gooseneck rotatable axis to be substantially tangential to a predetermined arc segment contained in plane that also contains the longitudinal axis 90 and yaw axis 16 of the vessel. FIG. 2 shows the attachment assembly in a rasied position and FIG. 3 shows the attachment assembly in a lowered position. The arc through which the attachment assembly passes making this transition represents the predetermined arc.

Figure 5A:
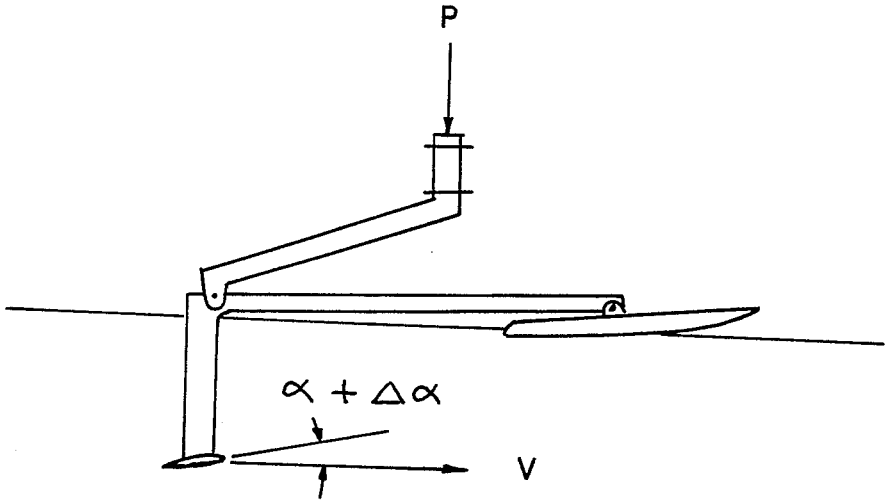
FIG. 5A is a side view of the invention hydrofoil apparatus in the operating position, the lifting foil presenting a high angle of attack of angle alpha plus delta alpha to approaching water at relative velocity V.
Figure 5B:
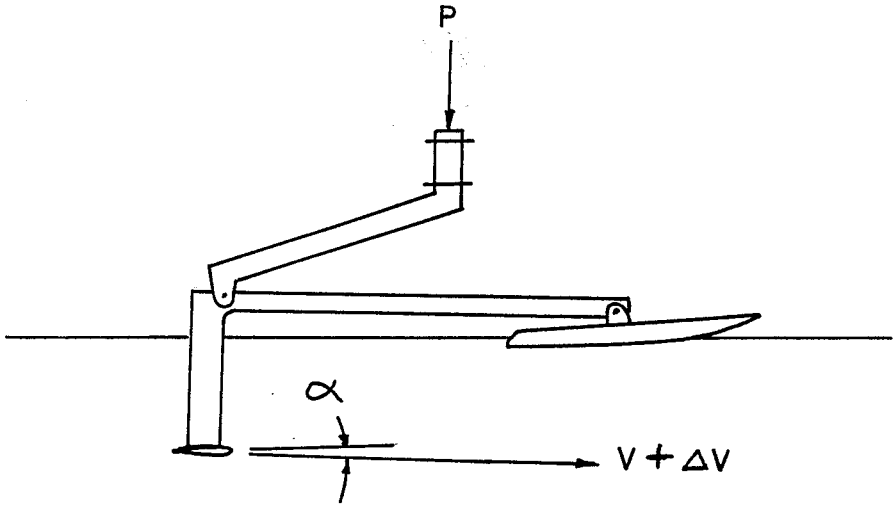
FIG. 5B is a side view of the invention hydrofoil apparatus in the operating position, the lifting foil presenting an angle of attack or angle alpha to approaching water at increased relative velocity V plus delta V.

FIG. 2 shows the vertical fin 50 upper end 52 coupled to the elongated body member aft end 46. The said vertical fin extends below the elongated member 40. The vertical fin 50 has a lower end 54 coupled to receive a lifting force from a submerged lifting foil 60 in response to vessel forward velocity V. As lifting foil 60 rises, its angle of attack diminishes thereby reducing the lift available if velocity is held constant. FIGS. 5A and 5B depict the reduction in angle alpha as the foil rises in response to increase velocity V.

FIGS. 9 ABCD show an alternate to the first pivot means 9 for positioning the gooseneck vertically relatively to the marine vessel 18. FIG. 9A shows the gooseneck in the retracted or raised position and FIG. 9B shows the gooseneck in the extended or lowered position. The power means 65 for raising or lowering the gooseneck is powered manually electrically, or hydraulically. FIG. 9C shows the power means 65 as a mechanical system. A screw 66 has a lower end 64 attached to the gooseneck housing 13. The screw is held in a threaded nut 67 that is held to the marine vessel 9d in bearing 68 so that the motor 69 can rotate the threaded nut 67 through a drive 70. The switch 71 controls the motor to drive the gooseneck to the desired vertical position. The electrical motor 69 can be replaced by other motor types or by a crank for manual operation.

Figure 9A:
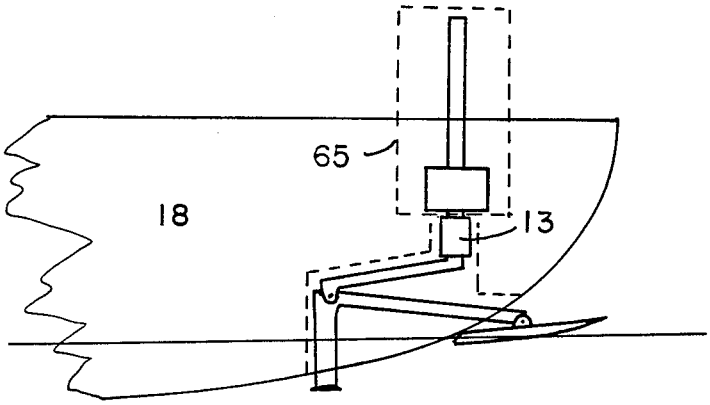
FIG. 9A is a side view of the invention hydrofoil apparatus in the retracted position.
Figure 9B:
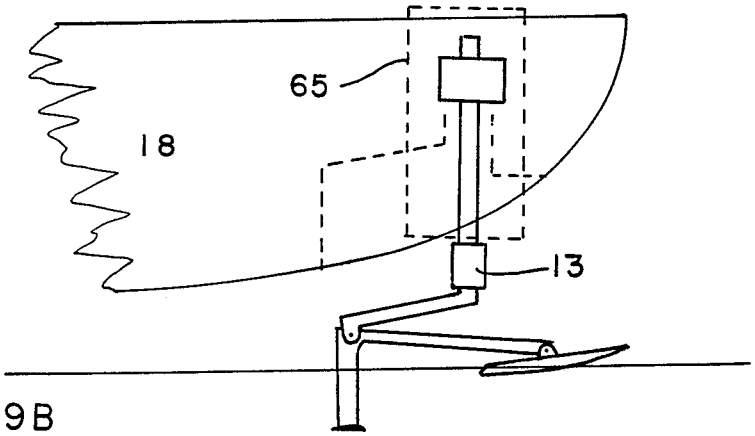
FIG. 9B is a side view of the apparatus in the extended position.
Figure 9C:
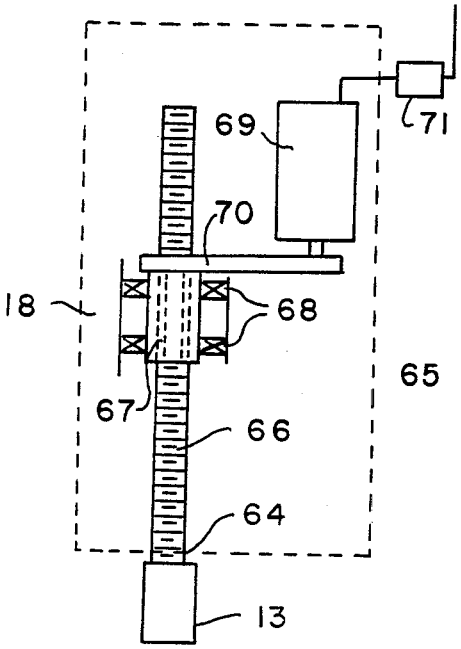
FIG. 9C is a mechanical means for raising or lowering the gooseneck vertical position.
Figure 9D:
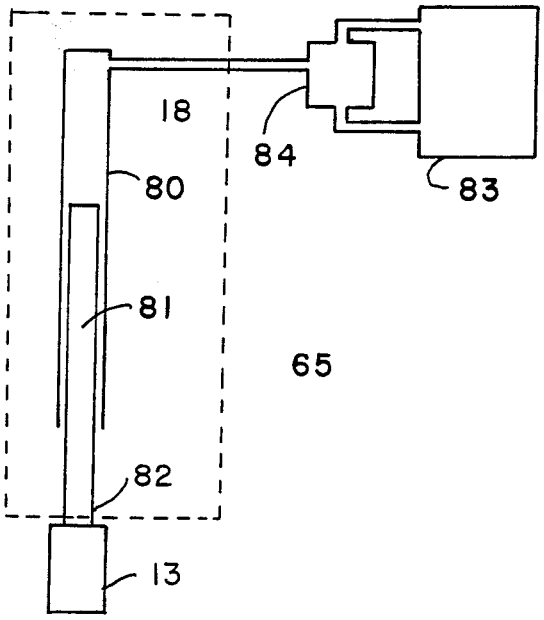
FIG. 9D is a hydraulic means for raising or lowering the gooseneck vertical position.

FIG. 9D shows the power means 65 as a hydraulic system. a cylinder 80 is attached to the vessel 18. A piston 81 operates in the cylinder. The piston lower end 82 is attached to the gooseneck 13. A pressure source 83 with control valves 84 is connected to the cylinder. The control valve 84 is used to drive the gooseneck to the desired vertical position.

OPERATION AND ANALYSIS

Referring to FIG. 1, the boat comprises a null 18, a drive shaft and propeller assembly 3, a lifting foil 4, and the invention hydrofoil apparatus 10 at the bow. The hull provides floation at rest, support at low speeds and has low drag below foil lift off speeds. The shaft rotation drives the propeller with sufficient angular velocity to force the vessel 18 forward through the water at sufficient forward velocity to reach liftoff speed.

The lifting foil produces sufficient vertical force to lift the hull out of the water, significantly reducing drag force thereby allowing the vessel to reach a greater speed than possible with the hull alone. The lifting foil 4 reduces its area as the hull rises out of the water further reducing drag. At higher speeds, less foil area is required to generate a lift force sufficient to lift the vessel out of the water.

The lifting foil 4 has dinearal or slope at the surface of the water. The slope of the lifting foil at the surface of the water normal to the direction of motion allows the foil to produce a torque about the roll axis 90 to correct for tipping, thereby contributing to added roll stability. The hydrofoil apparatus holds the bow of the hull at a constant height above the water independent of speed while operating above its design threshold velocity. As the vessel 18 slows down, the lifting foil 4 lift force diminishes allowing the hull or vessel 18 to move toward the water. As the foil moves lower in the water, its area increases and its angle of attack increases. Both of these factors operate to keep the load in balance. The load of the vessel and the lift from the foil continuously cooperate to balance the load and to hold the hull in a stable mode above the water.

The hydrofoil apparatus 10 shown in FIGS. 1 and 2 has a structure comprised of a horizontal foil 60 attached to a vertical strut or fin 50 and to a horizontal or elongated arm 40 to form a substantially "L" shaped structure. This "L" shaped structure is attached to a planing surface sensor 34 by a pivot with axis M horizontal and normal to the direction or velocity V. A trailing load support 24 is attached to the "L" shaped structure at pivot point N, the axis or pivot N being horizontal and normal to V. The trailing load support 24 is attached at its forward end to the bow attachment assembly with a vertical pivot axis 11. The bow attachment assembly 12 is attached to hull 18 as shown in FIG. 3 at horizontal axis 75. The operator line 97 is attached to the bow attachment assembly with line 96 by running through a pulley 95 so that the height position of the hull relative to the bow foil 60 can be controlled.

At speeds below liftoff, the bouyancy of the hull supports the weight of the vessel 18. At liftoff speeds, i.e. typically above 10 feet per second, the operator line 97 is pulled causing the bow to lift out of the water. This increases the angle of attack of the lifting foil 4 which produces enough lifting force to raise the hull out of the water. By adjusting the length of the operator line, the operator sets the height that the vessel operates above the surface of the water. This height can be set for a wide range of weights and speeds.

The angle of attack of the bow foil 60 is automatically and constantly self adjusted to produce a lifting force L1 that equals the load P at the bow. Since the planing surface sensor 34 rides on the average water surface, the bow foil will follow at a depth to produce an angle of attack to make force L1 equal to force P. If the lift is smaller than the load, the foil will sink which increases its angle of attack until the lift equals the load. If the load is smaller than the lift, the foil will rise decreasing its angle of attack thus reducing its lift to equal the force required by the load. The load - balance is thereby maintained in a stable mode.

Figure 6:
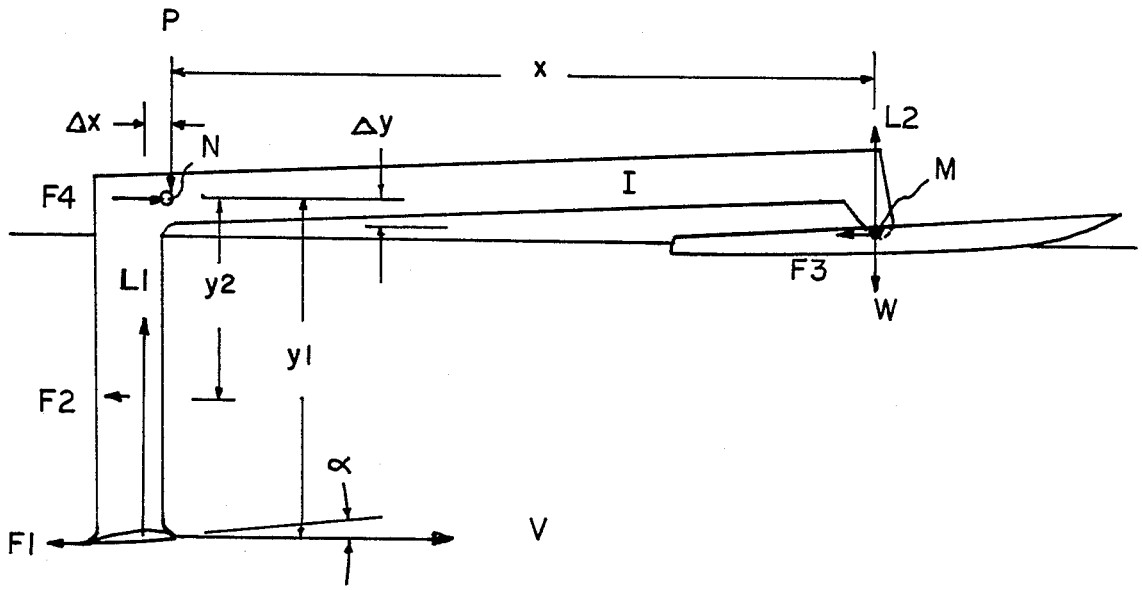
FIG. 6 is a side view of the invention hydrofoil apparatus in the operating position, characterizing each term for analysis.

Operation of the invention hydrofoil apparatus is explained in the following analysis with reference to the drawing of FIG. 6. In the following analysis, the symbol (^) will be used to signify multiplication and the symbol (/) will be used to signify division. The "L" shaped member is a rigid body rotating on axis "M". The "L" shaped body is depicted moving alone a smooth water surface with velocity "V". The forces and moments acting on this member are shown in FIG. 6. The parameters for analysis are defined below in TABLE 1 as follows:

TABLE 1

PARAMETERS FOR ANALYSIS

I: Moment of inertia about axis M
D: Damping about axis M
P: Applied vertical force on axis N
L1: Lift force of horizontal foil
L2: Lift force of planing surface sensor
F1: Drag force of horizontal foil
F2: Drag force of vertical fin
F3: Drag force of planing surface sensor F4: Applied horizontal force on axis N, equal to the total drag force W: Weight of planing surface sensor t: Time $\alpha$: Foil angle of attack - angle between foil reference line and velocity vector V. When L1 is zero, $\alpha$ is zero ($V \not\equiv 0$). (0 to 8 degrees)

$\dot{\alpha}$: Angular velocity $\ddot{\alpha}$: Angular acceleration $\psi$: Initial phase angle V : Velocity of foil parallel to water surface x: Distance between axes M and N (1.6 feet)

$\Delta x$: Horizontal distance between L1 and P $x^0$: Value of $\Delta x$ when $\alpha$ is zero (0.1 feet)

y1: Distance between F1 and axis N (0.75 feet)

y2: Distance between F2 and axis N (0.38 feet)

$\Delta y$: Vertical distance between F3 and axis N $y_0$: Value of $\Delta y$ when $\Delta$ is zero (0.2 feet)

A1: Area of horizontal foil (0.36 square feet)

A2: Area of vertical fin in water (0.12 square feet)

K: Foil lift constant (0.1 lb.sec.$^2$/deg.ft.$^4$)

The sum of the moments acting on the "L" shaped member about the axis M is given below in Equation 1.

$$I^*\ddot{\alpha}+D^*\dot{\alpha}+K^*A1^*V^{2*}(x+\Delta x)^*\alpha=P^*x-F1^*y1=F2^*y2 \quad \text{Eq.1}$$

Since F1*y1+F2*y2 is very small compared to P*x and $\Delta x$ is very small compared to x , Equation 1 simplifies to Equation 2 with less than 1.0 percent error being introduced into the predicted result.

$$I^*\ddot{\alpha}+D^*\dot{\alpha}+K^*A1^*V^{2*}x^*=P^*x \quad \text{Eq. 2}$$

The solution of $\alpha$ as a function of time for a step load change input P is given by Equation 3.

$$\alpha = P^*[1 + e^{t^*D/2^*I}\sin(V^*\sqrt{K^*A1^*x/I}\ ^*t - \psi)]/K^*A1^*V^2 \quad \text{Eq. 3}$$

A typical value of D/I is 100 so that for times greater than 0.1 sec. the angle $\alpha$ is within 1.0 percent of steady state value and is given by Equation 4 below.

$$\alpha=P/K^*A1^*V^2 \quad \text{Eq. 4}$$

It follows from Equation 4 that the foil force L1 is equal to the load P since $L1 = K^*A1^*V^{2*}\alpha$. If P increases, $\alpha$ increases to make $K^*A1^*V^2=L1$ equal to P with small time lag compared to the time changes in P. If P decreases, $\alpha$ decreases to make L1=P. The foil angle of attack, continuously changes to maintain L1=P for variations in P over the velocity range of operation, V.

Static stability is examined by summing the moments about axis N giving Equation 5.

$$L'2=(F1^*y1+F2^*y2+F3^*\Delta y+L1^*\Delta x+W^*x)/x \quad \text{Eq. 5}$$

If V is less than eight feet per second, L2 is negative and the pivot point M rises above the surface of the water. This limits operation to velocities above eight feet per second to support a load of 25 pounds for typical parameters. Parameter values for a typical design are show within parenthesis ( ) in Table 1 above.

In rough water the planing surface sensor 34 rides on the wave surface, jumping wave troughs and continually moving up and down. Since the planing surface sensor is forward of the lifting foil, the foil angle of attack anticipates the force required, thus providing lead in the system resulting in good dynamic stability in rough water conditions. The dynamic response of the apparatus is fast enough so that Equation 4 remains applicable over a wide range of practical conditions.

Figure 7:
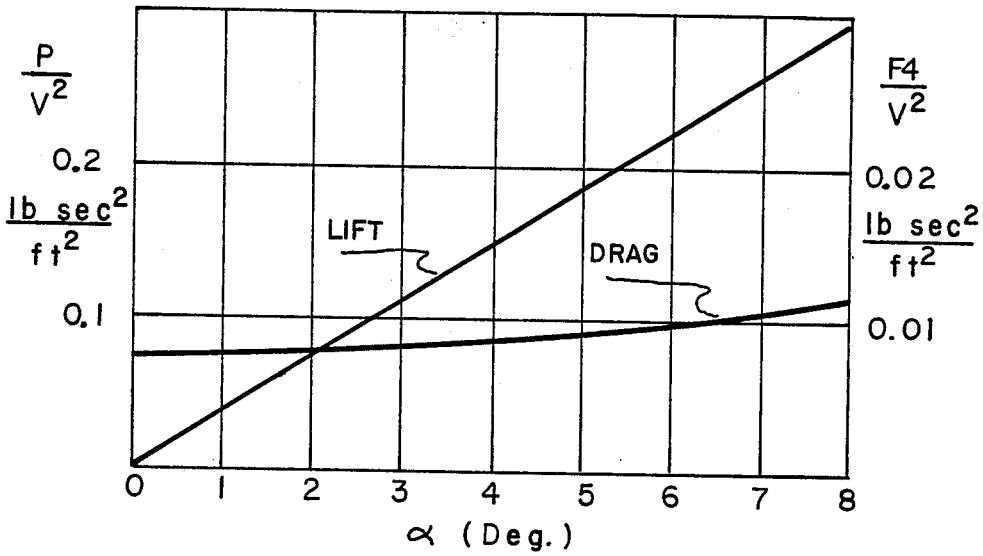
FIG. 7 is a graph of the operational characteristics of the invention hydrofoil apparatus.
Figure 8:
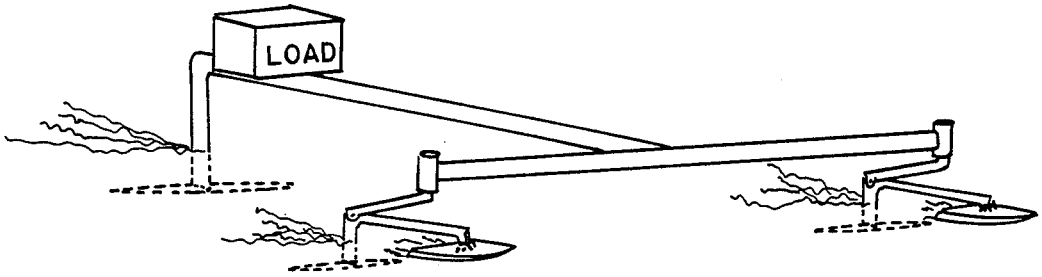
FIG. 8 is a perspective view of a supported schematic vessel using more than one of the invention hydrofoil apparatus assemblies.

Hydrofoil apparatus operation characteristics for a typical design are shown by the graphs of FIG. 7 for an operating range of from zero to seven degrees. The ratio of load to velocity, P/V, and the ratio of drag force to velocity, F4/V, are shown as functions of angle of attack. From these curves, the load and drag forces can be approximated for velocities within the useful range.

I claim:

1. A hydrofoil apparatus for attachment to a marine vessel comprising:

a first pivot means for positioning the rotational axis of a gooseneck shaft substantially parallel to the yaw axis of the hull of said marine vessel, a trailing load support having a forward end pivotally coupled to said gooseneck shaft for rotation on said yaw axis, and an aft end;

a planing surface sensor having a planing surface in contact with the water surface, said planing surface providing a hydrodynamic force to hold said planing surface on the water surface in response to vessel forward velocity, an elongated body member having a forward end and an aft end, said forward end being pivotally coupled to rotate on a first pitch axis with respect to said planing surface sensor, said elongated body member being pivotally coupled to rotate on a second pitch axis passing through a point located between said elongated body forward and aft ends and said trailing load support aft end, a vertical fin coupled to elongated body member, said fin being responsive to the forward motion of said marine vessel to maintain said planing surface sensor forward of said second pitch axis, a lifting foil coupled to said vertical fin, said lifting foil being responsive to the forward motion of said marine vessel to raise the bow of said marine vessel by provide a lifting force via said second pitch axis to balance the lifting force provided by said planing surface sensor applied to said first pitch axis.

2. The hydrofoil apparatus of claim 1 wherein said first pivot means for positioning the rotational axis of a gooseneck shaft substantially parallel to the yaw axis of the hull of said marine vessel, further comprises:

a bow attachment assembly for raising and lowering said gooseneck shaft with respect to the hull of said marine vessel.

3. The hydrofoil apparatus of claim 2 wherein said bow attachment assembly for raising and lowering said gooseneck shaft with respect to the hull of said marine vessel further comprises:

a principle structure having a forward end, a rear end, said principle structure being disposed along an axis between said forward and rear end, the rear end of said structure being positioned at a forward location on said vessel and being pivotally coupled to said vessel on a horizontal axis transverse to the longitudinal axis of said hull, said principle structure's axis being initially disposed to position said forward end to be in a substantially raised position forward of said rear end along said longitudinal axis of said vessel, said bow foil attachment structure forward end position describing a segment of a predetermined arc, the arc being contained in a substantially vertical plane as said structure is pivoted on said pivotal axis through said predetermined arc to move said forward end from a raised to a lowered position.

4. The hydrofoil apparatus of claim 2 wherein said bow attachment assembly of claim 2 for raising and lowering said gooseneck shaft with respect to the null of said marine vessel further comprises:

pulley means coupled to said bow foil attachment assembly for rotating it on said pivotal axis through a predetermined arc segment, said arc segment being contained in a plane passing through the longitudinal axis and the yaw axis of the vessel.

5. The hydrofoil apparatus of claim 2 wherein said bow attachment assembly of claim 2 for raising and lowering said gooseneck shaft with respect to the hull of said marine vessel further comprises:

means for raising and lowering said gooseneck with a screw drive with lower end of a screw attached coupled to said gooseneck and upper end of said screw passing through a a rotatable tapped thread member attached to said vessel bow, said rotatable tapped thread member being rotated manually;

means for rotating said gooseneck shaft under operator control to steer said vessel.

6. The hydrofoil apparatus of claim 2 wherein said bow attachment assembly of claim 2 for raising and lowering said gooseneck shaft with respect to the hull of said marine vessel further comprises:

means for raising and lowering said gooseneck with a screw drive with lower end of a screw attached coupled to said gooseneck and upper end of said screw passing through a a rotatable tapped thread member attached to said vessel bow, said rotatable tapped thread member being rotated electrically;

means for rotating said gooseneck shaft under operator control to steer said vessel.

7. The hydrofoil apparatus of claim 2 wherein said bow attachment assembly of claim 2 for raising and lowering said gooseneck shaft with respect to the hull of said marine vessel further comprises:

means for raising and lowering said gooseneck with a screw drive with lower end of a screw attached coupled to said gooseneck and upper end of said screw passing through a a rotatable tapped thread member attached to said vessel bow, said rotatable tapped thread member being rotated hydraulically;

means for rotating said gooseneck shaft under operator control to steer said vessel.

8. The hydrofoil apparatus of claim 2 wherein said bow attachment assembly of claim 2 for raising and lowering said gooseneck shaft with respect to the hull of said marine vessel further comprises:

means for raising or lowering said gooseneck with a hydraulic system comprising a vertical cylinder, a piston inside said vertical cylinder with lower end attached to said gooseneck, a pressurized fluid source and an operator valve to control fluid pressure on top of said piston;

means for rotating said gooseneck shaft under operator control to steer said vessel.

9. The hydrofoil apparatus of claim 1 wherein said first pivot means for positioning the rotational axis of a gooseneck shaft substantially parallel to the yaw axis of the hull of said marine vessel further comprises:

a gooseneck housing;

a gooseneck shaft axially positioned in and extending from said gooseneck housing, the axis of said rotational shaft characterizing a gooseneck rotational axis, said gooseneck housing being coupled to said bow attachment assembly forward end to position said gooseneck rotatable axis to be substantially tangential to a predetermined arc segment in a substantially vertical plane.

10. The bow hydrofoil apparatus of claim 1 wherein said vertical fin upper end is coupled to said elongated body member aft end, said vertical fin extending below elongated member, said vertical fin having a lower end coupled to receive a lifting force from a submerged lifting foil in response to vessel forward velocity.

11. A hydrofoil apparatus for attachment to a marine vessel comprising:

a bow attachment assembly pivotally coupled to the hull of said vessel on a horizontal axis transverse to the longitudinal axis of said hull, said bow attachment assembly being characterized to extend forward to a location clear of said vessel for a point of support, said bow attachment assembly being free to rotate on said pivotal axis through a predetermined arc free of interference from said hull;

means coupled to said bow attachment assembly for rotating it on said pivotal axis through said predetermined arc;

a gooseneck coupling having a rotatable shaft pivotally coupled to and extending from a gooseneck housing, said gooseneck housing being coupled to said bow attachment assembly point of support to position said gooseneck rotatable shaft to be substantially tangential to said predetermined arc;

a trailing load support and pivot means having a forward end coupled to said gooseneck rotational shaft and a aft end disposed to trail behind and below said trailing load support forward end;

a planing surface sensor having a planing surface in contact with the water, said planing surface providing a hydrodynamic lift force to hold said planing surface sensor to the water surface in response to vessel forward velocity, an "L" shaped member having a first end pivotally coupled to said planing surface sensor, said planing surface sensor having said planing surface in contact with the water surface to hold said first end of "L" shaped member at the water surface, said "L" shaped member having a lower end coupled to receive a lifting force from a lifting foil in response to vessel forward velocity, said "L" shaped member being pivotally coupled to and co-planar with said trailing load support and pivot means aft end;

said lifting force raising or lowering said "L" shaped member to a position of depth in the water, said "L" shaped member pivoting on said pivotal coupling to said planing surface sensor, whereby, the angle of attack of said lifting foil is reduced with increasing velocity, said rotation terminating as the force produced by said lifting foil plus the force produced by said planing surface sensor equal the downward force applied by the forward end of said marine vessel.

12. A hydrofoil apparatus for attachment to and use on a marine vessel, said vessel having forward motion in a direction corresponding to the longitudinal axis of said vessel on the surface of water, said hydrofoil apparatus comprising:

a bow attachment assembly having a forward end, a rear end and a principle structure along an axis disposed between said forward and rear end, the rear end of said structure being positioned at a forward location on said vessel and being pivotally coupled to said vessel on a horizontal axis transverse to the longitudinal axis of said hull, said principle structure's axis being initially disposed to position said forward end to be in a substantially raised position forward of said rear end along said longitudinal axis of said vessel, said bow attachment assembly forward end motion describing a segment of a predetermined arc, said arc being contained within a substantially vertical plane containing the longitudinal axis and yaw axis of the vessel, said principle structure being pivoted on said pivotal axis through said predetermined arc to move said forward end from a raised to a lowered position;

means coupled to said bow attachment assembly for rotating it on said pivotal axis through said predetermined arc;

a gooseneck coupling having a rotatable shaft axially positioned in and extending from said gooseneck housing, the axis of said rotational shaft characterizing a gooseneck rotational axis, said gooseneck housing being coupled to said bow attachment assembly forward end to position said gooseneck rotatable axis to be substantially tangential to said arc in said substantially vertical plane;

a trailing load support arm having a body member between a forward and aft end, said forward end being coupled to said gooseneck shaft and extending from said gooseneck rotatable axis at an angle of declination downwardly toward the stern end of said marine vehicle, a vertical strut having a lower and upper end, an elongated body member having a forward and aft end, said aft end being rigidly coupled to said vertical strut upper end at a junction to form a substantially "L" shaped member, said "L" shaped member being pivotally coupled at said junction with said load arm aft end, said pivotal coupling having an axis of rotation transverse to the plane of said "L" shaped member, said elongated body member being co-planar with said trailing load support arm and said gooseneck coupling rotational shaft;

a planing surface sensor having a planing surface in contact with the water, said planing surface sensor being pivotally coupled to said horizontal arm forward end to remain aligned with said arm and in contact with the water surface in response to being propelled by said marine vehicle through the water, said planing surface providing a hydrodynamic lift force via said pivotal coupling to said horizontal arm forward end;

a lifting foil having a cord flight axis and a center of lift, said lifting foil being rigidly coupled at its center of lift to said vertical strut lower end, its cord flight axis being inclined to provide a substantially positive angle of attack with said water in response to said marine vehicle forward motion, said lifting foil being characterized to provide a lift force axially thru said vertical strut to said trailing load support arm aft end via said "L" shaped member junction pivot in response to forward velocity of said marine vehicle through said water, said lifting foil providing force sufficient to raise said vertical strut and thereby raise said marine vehicle to a point of lift balance, said lift balance resulting from rotation of said "L" shaped members rotation about said arm forward end pivot, said rotation controlling the angle of attack of said cord flight axis thereby maintaining a force balance for a given load and forward velocity.

* * * * *